United States Patent [19]

Marom et al.

[11] Patent Number: 4,475,704

[45] Date of Patent: Oct. 9, 1984

[54] EXTENDED UNIT LOAD DEVICE

[75] Inventors: Hugo Marom, Zahala; Shlomo Adler, Kfar Saba, both of Israel

[73] Assignee: Adler Cargo Systems Limited, Kfar Saba, Israel

[21] Appl. No.: 321,633

[22] Filed: Nov. 16, 1981

[51] Int. Cl.[3] ..... B65D 19/00

[52] U.S. Cl. ..... 248/346; 108/55.1; 108/56.1

[58] Field of Search ..... 410/96, 90, 91, 94, 410/95, 46, 121; 248/346, 222.2; 108/55.1, 56.1, 51.1, 55.3, 55.5, 56.3

[56] References Cited

U.S. PATENT DOCUMENTS

| | | | |
|---|---|---|---|
| 2,936,985 | 5/1960 | Doerr et al. | 108/55.1 |
| 3,429,536 | 2/1969 | Petry et al. | 108/55.3 X |
| 3,444,829 | 5/1969 | Mork | 108/55.1 X |
| 3,478,995 | 11/1969 | Lautzenhiser et al. | 108/55.5 X |
| 3,699,901 | 10/1972 | Cook | 108/51.1 |
| 3,964,623 | 6/1976 | Verhein et al. | 108/55.3 X |
| 4,085,867 | 4/1978 | Heller | 248/222.2 X |
| 4,131,071 | 12/1978 | Glassmeyer | 108/56.1 X |

FOREIGN PATENT DOCUMENTS

| | | | |
|---|---|---|---|
| 781098 | 11/1980 | U.S.S.R. | 410/121 |

*Primary Examiner*—J. Franklin Foss
*Assistant Examiner*—David L. Talbott
*Attorney, Agent, or Firm*—Browdy and Neimark

[57] ABSTRACT

An extended unit load device for loading cargo into the lower decks of aircraft which comprises a standard pallet having a peripheral seat track and an inclined side support adapted to be pivotably and removably inserted in the track. The inclined side support may be mounted upon an attachment leg which comprises an engagement foot which engages the seat track and pivots in such a fashion as to lift the inclined side support to the inclined position. The inclined side support preferably comprises a sandwich of corrugated metal filled with polyurethane foam therebetween. Reinforcing rods may be inserted at periodic intervals along the length thereof. Cables affixed at one end thereof to each side of the inclined side support and at the other end thereof to the seat track serve to retain the inclined side support in the inclined position.

11 Claims, 3 Drawing Figures

EXTENDED UNIT LOAD DEVICE

FIELD OF THE INVENTION

This invention relates to unit load devices for loading cargo into airplanes in general and to extended unit load devices in particular.

BACKGROUND OF THE INVENTION

Typically cargo is loaded into the space in the lower decks of wide body jets and other aircraft on pallets, low portable platforms on which the cargo is stacked for transportation and storage. In order to maintain the cargo in position on the pallet, the cargo is generally stacked straight, so that it does not extend beyond the edges of the pallet. However, the lower decks of most aircraft do not have straight walls with the result that a great deal of space within the lower decks is not utilized.

SUMMARY OF THE INVENTION

It is, accordingly, an object of this invention to provide an extended unit load device which is portable and has extensions which are easily insertable and removable which utilizes the remaining space in the lower decks of aircraft for transportation of additional cargo.

There is thus provided in accordance with an embodiment of the present invention an extended unit load device comprising a standard pallet having a peripheral seat track, and an inclined side support adapted to be pivotably inserted in the track and oriented in an inclined position.

There is further provided in accordance with an embodiment of the present invention an extended unit load device wherein the inclined side support is affixed to an attachment leg which is adapted to pivotably and removably engage the seat track of the pallet.

There is still further provided in accordance with an embodiment of the present invention an extended unit load device further comprising a first cable attached at one end thereof to one side of the inclined side support and a second cable attached at one end thereof to the other side of the inclined side support, said first and second cables being anchored at the other ends thereof to the peripheral seat track so as to retain the inclined side support in the inclined position.

There is additionally provided in accordance with an embodiment of the present invention an extended unit load device wherein the inclined position of the inclined side support ranges from 0° to 45° from the horizontal.

There is further provided in accordance with a preferred embodiment of the present invention an extended unit load device wherein the inclined side support comprises a sandwich of two sheets of corrugated material filled with polyurethane foam therebetween. Reinforcing rods may be inserted at periodic intervals along the length thereof.

There is still further provided according to an embodiment of the present invention an extended unit load device wherein the attachment leg comprises an engagement foot which pivotably and removably engages the seat track of the pallet. It is preferred that the rotation of the engagement foot is restricted to limit the inclined position of the inclined side support to between 0° and 45° from the horizontal.

There is additionally provided in accordance with an embodiment of the present invention an extended unit load device provided with a rear support upon the inclined side support engageable to lift the side support to the desired inclined position.

BRIEF DESCRIPTION OF THE DRAWINGS

The present invention will be more fully understood and appreciated from the following detailed description taken in conjunction with the drawings in which.

DETAILED DESCRIPTION OF THE INVENTION

Figure 1:
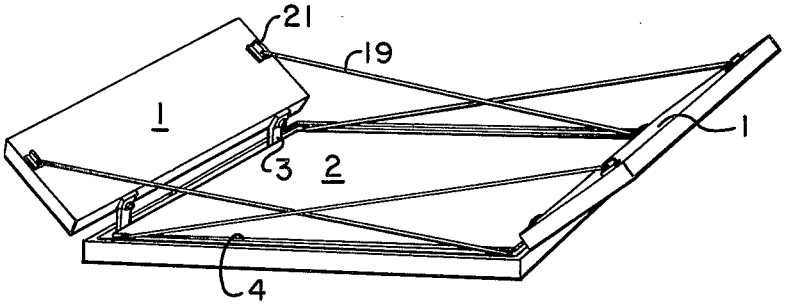
FIG. 1 is a perspective view of the device of the present invention as assembled for loading.

With reference to FIG. 1, there is shown an extended unit load device of the present invention comprising a standard pallet 2 having a peripheral seat track 4 and inclined side supports 1. Inclined side supports 1 are mounted upon attachment legs 3 which are insertable into seat track 4. Attachment legs 3 are designed to limit the orientation of side supports 1 to a maximum angle of 45° from the horizontal. Side supports 1 are further restrained in the desired position ranging from 0° to 45° from the horizontal, depending upon the requirements of the aircraft, by cables 19 affixed to the supports as by double studs 21. As can be seen from FIG. 1, use of the device of the present invention permits the loading of 25–40% more cargo than upon a standard pallet alone, when the cargo does not exceed the weight limit of the aircraft. The entire weight of the cargo is supported by the pallet, not by any external support, and there is no force exerted on the aircraft envelope.

It will be appreciated that one side support 1 may be utilized without the other according to the amount of cargo to be loaded. It will further be noted that due to the hingelike seating of attachment legs 3 in track 4, one or both inclined side supports 1 may be folded flat upon standard pallet 2 when not needed and cargo may be loaded thereupon, or more than 60 side supports may be transported upon the pallet.

Figure 2:
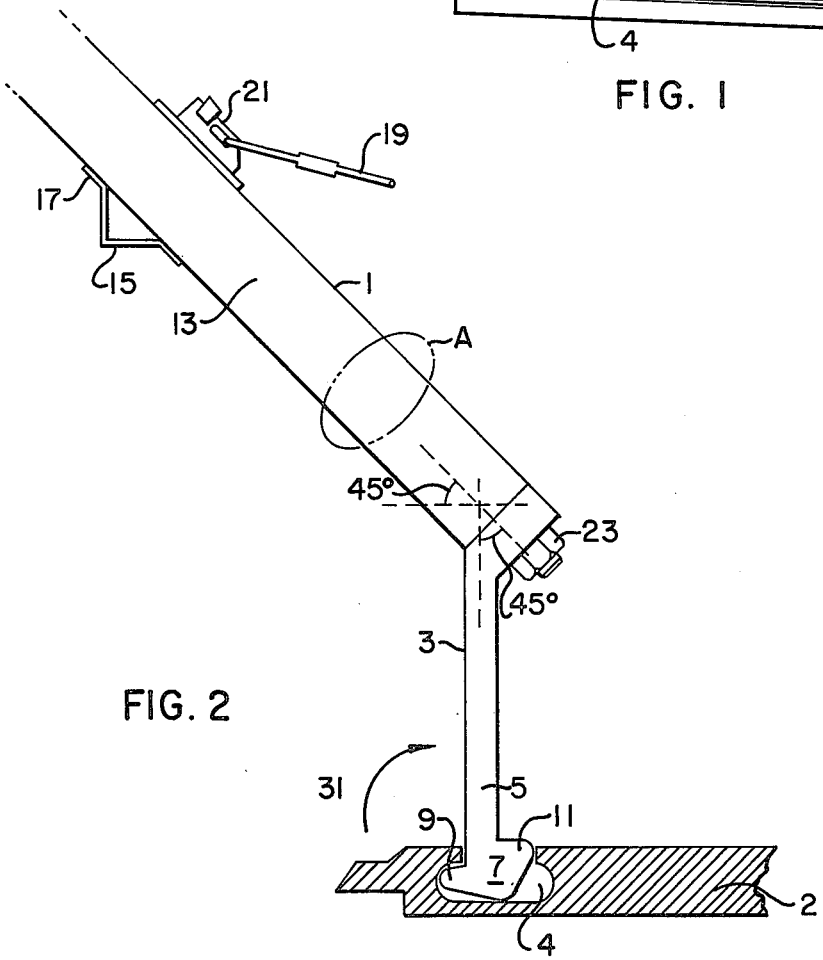
FIG. 2 is a schematic side view of the device.

The details of construction and operation of the device of the present invention will be discussed with reference to FIG. 2 which shows an inclined side support, generally designated 1, mounted in a standard pallet 2 having a peripheral seat track 4. Side support 1 is mounted, as by bolts 23, upon attachment leg 3 such that the angle between the longitudinal axis of side support 1 and the horizontal plane is 45°. Attachment leg 3 comprises bar 5 and engagement foot 7. Engagement foot 7 comprises toe portion 9 adapted to be removably inserted within seat track 4, and heel portion 11 which acts as a stop to limit the rotation of attachment leg 3 within track 4 in the direction of arrow 31. It will be noted that once toe portion 9 is inserted into track 4 and attachment leg 3 is pivoted in the direction of arrow 31, engagement foot 7 is effectively locked within track 4 and cannot be disengaged therefrom except by pivoting in the opposite direction. Attachment leg 3 is generally made of aluminum, although any material strong enough yet light enough to function as described may be utilized. Engagement foot 7 may be cast, extruded or machined as is known in the art.

It will be appreciated that the design of the engagement foot in the present invention is such that the weight of the cargo does not apply torsion via the foot 7 to the track. The weight of the cargo acts to urge side support 1 towards the horizontal position and cables 19 retain side supports 1 in position.

Inclined side support 1 is bounded on its periphery by aluminum frame 13. Permanently affixed to each side of side support 1 as by double studs 21 is one end of a cable 19. Cable 19 may comprise a strap or steel cable. If more than 350 Kg of cargo is loaded on the side support, steel cables must be used. The other end of cable 19 is anchored by standard anchors to the seat track 4 in such a location as to hold side support 1 in the desired inclined position. As stated above, in this orientation there is no force whatsoever on the aircraft envelope due to the cargo. In the event of a cable break side supports 1 will be held in position primarily by a cargo net. Secondarily the load which is evenly distributed by the supports 1 will lean against the aircraft walls.

Inclined side support 1 is additionally provided with a rear support 15 attached to the non-cargo engaging face of the support as by bolts 17. Rear support 15 is engageable by a fork lift or other lifting means to lift inclined side support 1 to the desired angle for loading.

Figure 3:
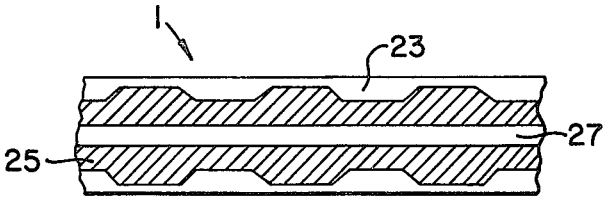
FIG. 3 is a detail sectional view of area A on FIG. 2.

With reference to FIG. 3, there is shown a sectional view of a preferred embodiment of an inclined side support 1. In this embodiment, side support 1 comprises a sandwich of two sheets of corrugated material 23 joined by a filling 25 of polyurethane foam. The foam adds stability and rigidity to side support 1 without adding undue weight. Sheets 23 generally comprise aluminum which may be formed into corrugated sheets by any known method, such as pressing. However, any other suitable material or method may be utilized. To further support and strengthen side support 1, reinforcing rods 27 of a suitable strong but light material may be inserted at periodic intervals along the length of support 1 into the polyurethane foam 25.

In operation, one or two inclined side supports, as needed, are inserted into the peripheral seat track of a standard pallet, provided to the desired incline as determined by aircraft requirements and affixed with cables at that desired incline. The extended pallet is now loaded as usual with the desired amount of cargo. The weight of additional cargo which can be supported by inclined side supports of the present invention depends upon the size thereof but is on the order of 500 Kg. per support. Once loaded, a standard net is affixed to the track about the cargo pallet and encloses the side supports. The extended pallet is now ready to be loaded into the lower deck of an aircraft in the same manner as a standard pallet and cargo net combination.

It will be appreciated by those skilled in the art that the device of the present invention is not limited by what is particularly shown and described hereinabove. Rather, the scope of the invention is defined only by the claims which follow.

What we claim is:

1. An extended unit load device comprising:

a standard pallet having a peripheral seat track, disposed in its operative orientation in a horizontal plane, said peripheral seat track defining in cross section a recess and first and second edge members partially overlapping said recess;

an inclined side support adapted to be removably and pivotably inserted in the track and oriented in an inclined position, said inclined side support including an attachment leg having an elongate upstanding portion having a generally vertical operative orientation, perpendicular to the plane of said standard pallet, and a foot portion including a toe portion extending in operative orientation sideways in cross section and underlying said first edge member and a heel portion extending in operative orientation sideways in cross section and engaging said second edge member;

a first cable attached at one end thereof to one side of the inclined side support; and a second cable attached at one end thereof to the other side of the inclined side support;

said first and second cables being anchored at the other ends thereof to the peripheral seat track so as to retain the inclined side support in the inclined position.

2. An extended unit loading device according to claim 1 and wherein said an attachment leg is affixed to the inclined side support and is adapted to removably and pivotably engage the seat track of the pallet.

3. An extended unit load device comprising:

a standard pallet having a peripheral seat track, disposed in its operative orientation in a horizontal plane, said peripheral seat track defining in cross section a recess and first and second edge members partially overlapping said recess;

an inclined side support;

an attachment leg affixed to the inclined side support which is adapted to be removably inserted in the track and pivoted so as to lift the inclined side support to an inclined position, said attachment leg having a foot portion including a toe portion extending in operative orientation sideways in cross section and underlying said first edge member and a heel portion extending in operative orientation sideways in cross section and engaging said second edge member and first and second cables attached at one end thereof to each side of the inclined side support and at the other end thereof to the track so as to retain the inclined side support in the inclined position.

4. An extended unit load device according to claim 3 and wherein the inclined position ranges from 0° to 45° from the horizontal.

5. A device according to claim 3 and wherein the inclined side support comprises a sandwich of two sheets of corrugated material filled with polyurethane foam therebetween.

6. A device according to claim 5 and further comprising a plurality of reinforcing rods inserted at periodic intervals along the length of the support into the polyurethane foam.

7. A device according to claim 3 and wherein the attachment leg comprises an engagement foot which pivotably and removably engages the seat track of the pallet.

8. A device according to claim 7 and wherein the rotation of the engagement foot is restricted to limit the inclined position of the inclined side support to between 0° and 45° from the horizontal.

9. A device according to claim 3 and wherein the cable comprises a steel cable.

10. A device according to claim 3 and further comprising a rear support mounted on the side support engageable to lift the side support to the desired inclined position.

11. An extended unit load device according to claim 1 and wherein said peripheral track defines in cross section a first separation between said first and second edge members and said foot portion is arranged in said operative orientation to bridge said first separation and simultaneously to engage said first and second edge members.

* * * * *